US009617620B2

(12) United States Patent
Arakawa et al.

(10) Patent No.: US 9,617,620 B2
(45) Date of Patent: Apr. 11, 2017

(54) METHOD FOR REDUCING ALUMINA OR MAGNESIA BY UTILIZING SUPERSONIC GAS FLOW

(71) Applicants: Japan Expert Clone Corporation, Tokyo (JP); The University of Tokyo, Tokyo (JP); Tokyo Metropolitan University, Municipal University Corporation, Tokyo (JP)

(72) Inventors: Yoshihiro Arakawa, Chiba (JP); Masakatsu Nakano, Tokyo (JP); Makoto Matsui, Shizuoka (JP); Tetsuya Goto, Tokyo (JP)

( * ) Notice: Subject to any disclaimer, the term of this patent is extended or adjusted under 35 U.S.C. 154(b) by 132 days.

(21) Appl. No.: 14/421,181

(22) PCT Filed: Mar. 8, 2013

(86) PCT No.: PCT/JP2013/056417
§ 371 (c)(1),
(2) Date: Feb. 12, 2015

(87) PCT Pub. No.: WO2014/030369
PCT Pub. Date: Feb. 27, 2014

(65) Prior Publication Data

US 2015/0203937 A1 Jul. 23, 2015

(30) Foreign Application Priority Data

Aug. 22, 2012 (JP) ..... 2012-183356

(51) Int. Cl.
*C22B 4/02* (2006.01)
*C22B 5/14* (2006.01)
(Continued)

(52) U.S. Cl.
CPC ..... *C22B 26/22* (2013.01); *C22B 4/02* (2013.01); *C22B 5/12* (2013.01); *C22B 5/14* (2013.01); *C22B 21/02* (2013.01); *C22B 21/04* (2013.01)

(58) Field of Classification Search
CPC .... C22B 5/12; C22B 5/14; C22B 4/02; C22B 21/02; C22B 26/22; C22B 21/04
See application file for complete search history.

(56) References Cited

FOREIGN PATENT DOCUMENTS

JP 2011032131 A * 2/2011

OTHER PUBLICATIONS

Arakawa,Yoshihiro et al. "Research and Development of an Energy Cycle System Using Aluminum." Journal of IAPS 20(1) 2012. pp. 3-7. Human translation.*

(Continued)

*Primary Examiner* — George Wyszomierski
*Assistant Examiner* — Tima M McGuthry Banks
(74) *Attorney, Agent, or Firm* — Frank A. Mazzeo; Ryder, Lu, Mazzeo & Konieczny LLC

(57) ABSTRACT

An alumina- or magnesia-reducing process in which a greenhouse gas or substance harmful to the human body is not emitted, which can achieve improved energy efficiency in comparison with the Hall-Heroult or Pidgeon methods. The process includes: introducing an alumina or magnesia powder with a carrier gas to the upstream side of a throat provided on a reducing unit; pressure-transferring the powder and carrier gas to the throat by an operative gas introduced to the upstream side of the throat; irradiating the throat with a laser beam to convert the alumina or magnesia into a plasma state and dissociate the alumina or magnesia thermally; jetting the thermally dissociated product through a nozzle provided on the downstream side of the throat at a supersonic speed to form a frozen flow; and isolating (Continued)

aluminum or magnesium. Hydrogen may be added to the operative gas to accelerate the reduction of alumina or magnesia.

10 Claims, 4 Drawing Sheets

(51) Int. Cl.

| | |
|---|---|
| ***C22B 5/12*** | (2006.01) |
| ***C22B 21/02*** | (2006.01) |
| ***C22B 21/04*** | (2006.01) |
| ***C22B 26/22*** | (2006.01) |

(56) References Cited

OTHER PUBLICATIONS

Nakamura et al. JP 2011032131 A published Feb. 2011. Machine translation.*

* cited by examiner

METHOD FOR REDUCING ALUMINA OR MAGNESIA BY UTILIZING SUPERSONIC GAS FLOW

FIELD OF THE INVENTION

The present invention relates to a method for reducing alumina (aluminum oxide) or magnesia (magnesium oxide) by utilizing supersonic gas flow for isolating aluminum or magnesium.

BACKGROUND

Aluminum is a widely used metal for industrial products such as construction materials because of its light weight, easy processing characteristics, and high corrosion resistance owing to protection made by oxide film surrounding its surface. From processing view point, a variety of processing, such as stamping, extruding, or casting may be applied, and from alloying view point, duralumin is well known as an example. Further, it is also used in other technological fields by making use of its excellent heat conductivity or electricity conductivity. Aluminum is also a metal having potential to be used as energy source in the future, since it generates high energy when combusted, and its energy density per volume is comparable with even coal or petroleum (41.9 kJ/$cm^3$).

From historical view point, its origin is discovery of alumina in early 19th Century, and it had been considered as precious metal until technique for isolating aluminum from alumina was established, but its availability is improved after the Hall-Heroult process was found at the end of 19th century. Detailed explanation of the Hall-Heroult process is omitted here since it is widely used today as a method for refining aluminum, but in brief, an ore called bauxite containing high percentage of alumina is melt with sodium hydroxide and extracting alumina out of it (Bayer process), the alumina is then melt in electrolytic bath (1300K) using cryolite (Ga3AlF6), and thereafter aluminum is refined by electrolysis using carbon electrodes. Carbon electrode used as anode acts as reducing agent, which combines with oxygen contained in alumina and generates carbon dioxide and carbon monoxide (1100K or more).

$$Al_2O_3+3C \rightarrow 2Al+3CO$$

$$Al_2O_3+3/2C \rightarrow 2Al+3/2CO_2$$

Although the Hall-Heroult process is used as a major method even today for dissociating alumina, the method has problems that it consumes a large amount of electric power for dissociating alumina (electric power consumed for 1 ton of aluminum: 13,000-14,000 kWh), and further it emits a large volume of greenhouse effect gas such as CO or $CO_2$ as shown in the above formulas. Especially, the latter problem has direct influence on warming up of the earth, hence it is a big issue on global scale to develop alternative methods for reducing alumina.

Some technological developments of the Hall-Heroult process are underway for improving its energy efficiency (for example, refer to "patent document 1"), or some alternative reducing methods that may replace the Hall-Heroult process (for example, refer to "patent document 2" and "patent document 3") are proposed, but these counter measures would not fundamentally resolve the above mentioned problems, therefore there still remains need for drastic improvement in the method for reducing alumina.

On the other hand, magnesium is even lighter in weight compared to aluminum, and easy for processing, therefore it is a widely used metal as industrial material in the field of such as automobile, aerospace, or machinery equipment, and it is also used as an additive for improving mechanical characteristics of a variety of materials. From processing view point, extruding, stamping, forging etc. may be applied, therefore it may cover a wide range of industrial application. Although it tends to be corroded due to its relatively high chemical activity, it is possible to make it in stable condition by applying surface treatment. It is also known that it generates a large amount of energy when it is combusted (601.7 kJ/mol).

Historically, commercial production of magnesium was started in late 19th century, almost the same timing as aluminum, but timing of wide use of it became somewhat belated due to difficulty of its refining process. Thermal reduction method and electrolytic method are known today as methods for refining magnesium. In the former method, which is a major method today, magnesia obtained by burning dolomite ore is reduced by adding reducing agent and heating it at high temperature under low pressure (known as the Pidgeon process).

$$2MgO+Si \rightarrow SiO_2+2Mg$$

In the latter process, magnesium is obtained by electrolyzing mercuric magnesium gained mainly from sea water (known as electrolysis refining process).

$$MgCl_2 \rightarrow Mg+Cl_2$$

However, since both of these processes are the same in a sense that a large amount of electric power needs to be consumed, a novel method for refining magnesium with low energy consumption is also required.

SUMMARY OF THE INVENTION

Technical Problems

Based on the above description, the purpose of the present invention is to provide a method for reducing alumina or magnesia that would not emit greenhouse effect gas and improve energy efficiency, by resolving the above mentioned problems in connection with the Hall-Heroult process for aluminum, and by resolving the above mentioned problems in connection with the Pidgeon process which is a major refining method for magnesium

Measures for Solving the Problems

The present invention resolves the above-described problems by thermally dissociating aluminum or magnesium from oxygen by heating alumina or magnesia by using heating means such as laser beam and putting them into plasma state, and preventing them from re-combining to each other by making the gas in plasma state into supersonic gas flow. More specifically, the present invention includes the following.

That is, one aspect of the present invention is directed to a method for reducing alumina or magnesia, wherein the method includes a step of heating alumina powders or magnesia powders by heating means thereby putting it in a plasma state and thermally dissociating aluminum or magnesium from oxygen, and a step of ejecting the gas in the plasma state in a form of supersonic jet steam from a nozzle so as to make it in frozen flow, thereby isolating aluminum or magnesium.

For isolating aluminum and magnesium in the above mentioned aspect, the method can be structured in such a manner that alumina powders or magnesia powders are fed into a reducing device together with carrier gas at upstream of a throat portion provided to the reducing device, operating gas is introduced similarly at upstream of the throat portion, gas pressure of which forcedly transport the fed powders toward the throat portion, and heating means heats the throat portion, thereby dissociating alumina or magnesia, which is then ejected in a form of supersonic jet gas stream from the nozzle located at downstream of the throat portion.

In the above mentioned aspect, hydrogen can be further added to the operating gas. Such addition would promote reducing of alumina or magnesia by action of the added hydrogen.

In the above mentioned aspect, the method may further includes a step of controlling volume of alumina powders or magnesia powders to be fed at upstream of the throat portion. Also, the method can further includes a step of guiding isolated aluminum or magnesium into a cooling tube so as to deposit aluminum or magnesium inside of the cooling tube and collect the same.

Advantageous Effects of the Present Invention

Implementation of the present invention makes it possible to perform reduction of alumina or magnesia without emitting greenhouse effect gas or other harmful gas, and reducing electric power consumption in comparison with the prior art Hall-Heroult process or Pidgeon process.

DETAILED DESCRIPTION

Figure 1:
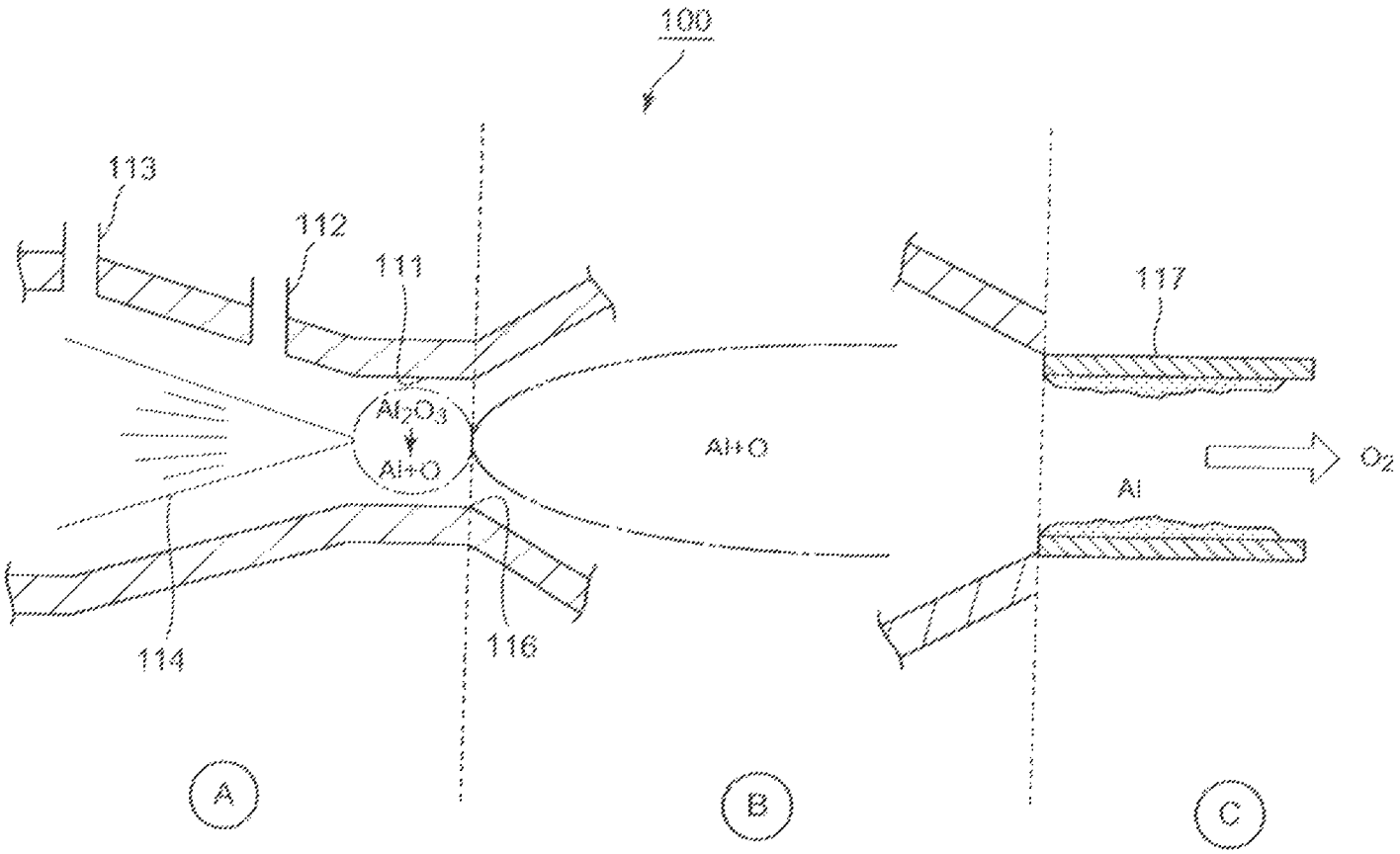
FIG. 1 is an explanatory drawing showing outline of method for reducing alumina (hereinafter, magnesia may similarly be applied) according to one embodiment of the present invention.

The first embodiment of the method for reducing alumina or magnesia by using laser according to the present invention is now be described by referring to appended drawings. Although illustration in drawings and the following explanation are directed to a method for reducing alumina as a representing example, the devices and processes used hereinafter are basically applicable to reducing magnesia in a similar manner, except difference of base materials to be used between alumina powders and magnesia powders. FIG. 1 shows outline of the method for reducing alumina according to the present embodiment, in which a laser sustaining technology and a laser plasma tunnel technology derived therefrom are applied. By referring to FIG. 1, the method for reducing alumina is mainly structured by a step of thermally dissociating alumina as shown in area A on left hand side of the drawing, a step of separating aluminum and oxygen and isolating aluminum as shown in area B in the center of the drawing, and a step of recovering isolated aluminum as shown in area C on right hand side of the drawing, in which each of the areas is divided by dotted lines. These steps flow from left hand side to right hand side in each of the areas.

First, at the step of thermally dissociating alumina shown in area A on left hand side of the drawing, a throat portion 111 is provided in inside of a reducing device 100 used in the present embodiment for throttling the flow flowing through it, and an alumina feeding gate 112 is provided at upstream thereof (left hand side of the drawing), and an operating gas introducing gate 113 is also provided on even far upstream side. Alumina powders are fed into inside of the device from the alumina feeding gate 112 together with carrier gas such as argon, and pressurized operating gas comprising oxygen and inert gas such as argon is introduced from the operating gas introducing gate 113. Mixing ratio between alumina and carrier gas to be fed from the alumina feeding gate 112 is properly controlled in such a manner that alumina content is in a range of, for example, about 0.1-0.6 g/l (l: little). Further, pressure of the operating gas to be introduced from the operating gas introducing gate 113 is desirably about 10 atm. Mixture of alumina and carrier gas is forcedly transported by operating gas pressure from left hand side to right hand side of the drawing toward the throat portion 111.

In the throat portion 111, a laser beam 114 is irradiated from right hand side of the drawing focusing on the throat portion 111. In the present embodiment, carbon dioxide gas laser having 34 mm beam diameter, maximum output of 2 kW, and wave length of 10.6 μm is used, but such specification of laser beam 114 may be changed as far as it has enough energy sufficient to put alumina into plasma state. Temperature at the vicinity of focal point of the laser beam becomes as high as 12,000K locally, and alumina is melt due to such high temperature heat (melting point of alumina is 2,300K, and that of magnesia is 3,070K), and is put in plasma state thereby it is thermally dissociated into aluminum and oxygen. At this stage, a phenomena so called inverse bremsstrahlung radiation is generated in which atom is accelerated through absorbing beamed laser power, and plasma is heated by repeated coulomb collision among atoms and ions.

$$Al_2O_3=2Al+3/2O_2-838\ kJ$$

Operation is then moved to area B located in the center of the drawing, in which gas in plasma state, expanded by heating and throttled at throat portion 111, is ejected in a form of jet stream from the nozzle 116 which is an exit of the throat portion 111 toward right hand side of the drawing. Gas flow at this stage becomes supersonic flow such as 1,000-3,000 m/s in speed, and the gas flow is instantly cooled due to rapid expansion. In case of the prior art Hall-Heroult process, among electrolyzed alumina elements, oxygen is separated by being drawn by anode and combines with carbon, thereby being isolated in a form of carbon monoxide or carbon dioxide, and only remaining element, aluminum, is deposited in the electrolytic bath and collected. However, in case of no reducing agent such as carbon electrode is provided, even if alumina is once thermally dissociated into aluminum and oxygen, aluminum and oxygen having strong combining force tend to re-combine to each other and return to alumina during cooling process. On the other hand, according to the present embodiment, since separated aluminum and oxygen in plasma state are rapidly cooled in frozen supersonic gas flow down to normal temperature, re-combination of aluminum and oxygen is prevented and their separated condition can be maintained. Such fact can be confirmed by emission light spectrum measurement in which peaks of emission light spectrum unique to aluminum are observed.

Thereafter, the flow moves to area C on right hand side of the drawing, and only isolated aluminum is recovered. In the example shown in the drawing, a cooled copper tube 117 is provided into which the flow is guided and separated oxygen in gaseous state is discharged while aluminum is accumulated on inner wall of the copper tube 117 and collected. Such method for recovering is just an example, and some other methods may be adopted, such as using a filter device capable of selectively permeating oxygen and capturing aluminum powders.

Figure 2:
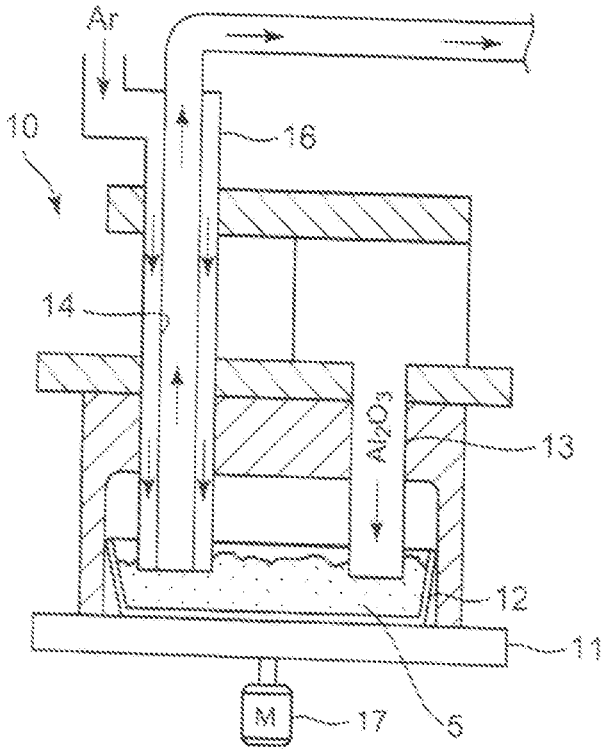
FIG. 2 is a structural drawing of alumina powder (or magnesia powder) feeding device used for the method for reducing alumina shown in FIG. 1.

As explained above, it is desirable to properly control content of alumina powders in the mixture of introduced alumina powders and carrier gas. FIG. 2 shows one example of alumina feeding device for controlling volume of alumina powders to be fed. In FIG. 2, the alumina feeding device is structured by, from lower level, an alumina container 12 placed on a turntable 11, alumina releasing tube 13 for releasing alumina powders into the alumina container 12, alumina feeding tube 14 for taking out alumina powders from the alumina container 12, and a carrier gas supplying tube 16 for dragging in and transporting alumina powders.

Turntable 11 is rotated by a motor 17, and its rotational speed may be controlled by a controller not shown in the drawing. Proper volume of alumina powders 5 are released in a timely manner from the releasing tube 13 into the alumina container 12. By providing a sensor (not shown in the drawing) to tip of the releasing tube 13 for detecting level of alumina powders in the alumina container 12, it is possible to release proper volume of alumina powders 5 so as to maintain height level of the powders constant. Alumina powders may be replenished once in a while to the releasing tube 13. In the present embodiment, alumina powders having diameter of about 0.03 to 3 μm may be used, but it is desirable to select and use alumina powders having almost the same diameter for one batch treatment so as to stably control feeding volume rate of alumina powders. The alumina feeding tube 14 and the carrier gas supplying tube 16 are formed in a double-tube structure, and carrier gas such as argon or helium may be supplied downwardly from upper side through the carrier gas supplying tube 16 located at outer side of the double-tube structure. Since height of the double tube structure is adjusted at a level just establishing contact with alumina powders 5 in the alumina container 12, the aluminum powders 5 are mixed with the carrier gas due to pressure of the carrier gas, and the mixed carrier gas containing the alumina powders 5 is then forcedly pushed into inside of the alumina feeding tube 14 in upward direction from lower end, and further it is supplied to the alumina feeding gate 112 shown in FIG. 1.

Actions of the alumina feeding device 10 as structure above are: first, alumina powders 5 are released into the alumina container 12 from the alumina releasing tube 13, and then the turntable 11 is rotated by the motor 17. Next, carrier gas is supplied from upper side of the carrier gas supplying tube 16, alumina powders 5 are dragged in by the carrier gas at lower end of the double-tube and forcedly pushed into the alumina feeding tube 14, and the mixed gas is then supplied to alumina feeding gate 112 of the alumina reducing device 100 shown in FIG. 1. Alumina feeding volume rate may be controlled by adjusting rotational speed of the turntable 112. Some other controlling method for controlling feeding volume rate of alumina may be adapted, one of such examples is to use a table capable of moving up and down instead of using the turntable. The above mentioned double-tube structure is also just one example, and some other method for feeding alumina powders may be adapted.

Figure 3:
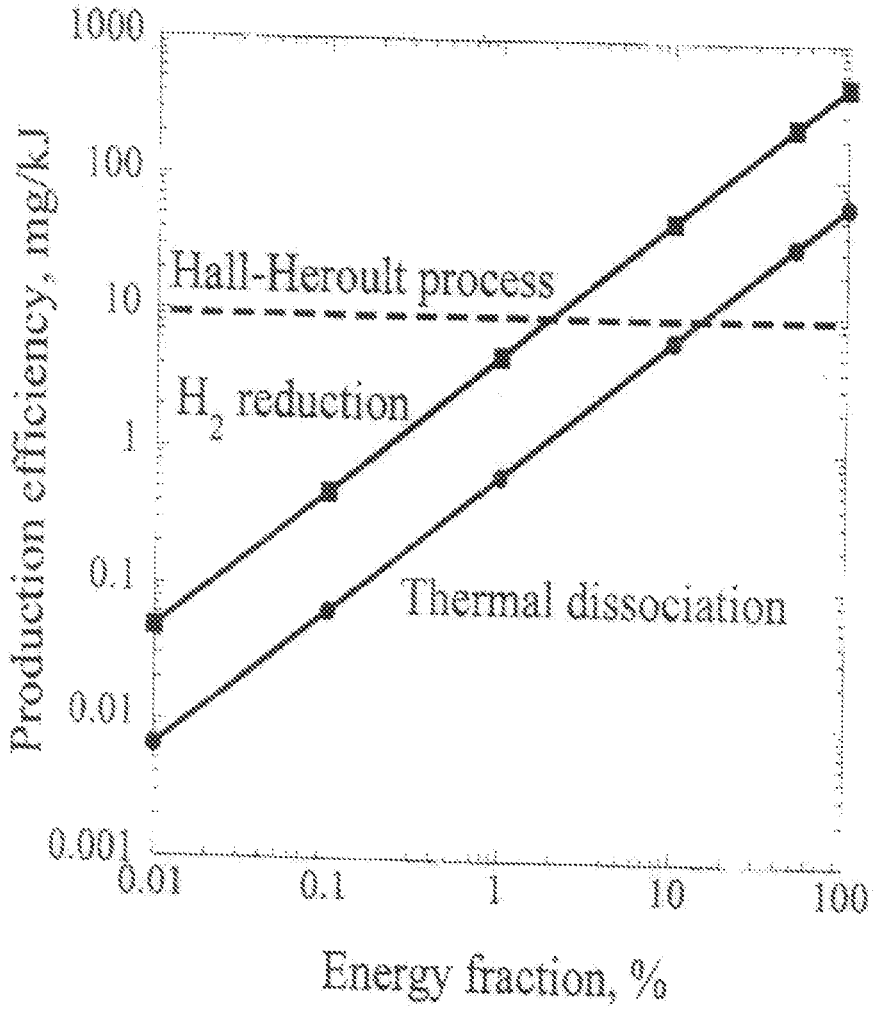
FIG. 3 is a graph showing comparison of production efficiency between the method for reducing alumina according to embodiments of the present invention and the prior art Hall-Heroult process.

FIG. 3 shows aluminum production efficiency according to the method for reducing alumina by utilizing laser beam of the present embodiment, in which the horizontal axis represents energy fraction or efficiency of usage of introduced energy (%), and the vertical axis represents aluminum production efficiency (mg/kJ). Aluminum production efficiency according to the present embodiment is shown by solid line with ● marks, and, for a comparison purpose, aluminum production efficiency by the Hall-Heroult process is shown by dotted line (about 10 mg/kJ). As a result of such comparison, the method for reducing alumina using laser beam according to the present embodiment would be superior to the Hall-Heroult process in terms of production efficiency when about 30% of introduced energy is utilized for reducing. Based on a result of an experiment conducted by the present inventors, energy created by the laser beam is partially lost due to wall surface heat loss at the throat portion shown in FIG. 1 (about 40%), chemical loss (about 15%), and permeating loss (about 10%), and yet at least 35% of created energy may effectively be used, which means that the method of reducing alumina according to the present embodiment could achieve higher production efficiency compared to the Hall-Heroult process. In addition, fundamental advantageous feature of the present invention compared to the Hall-Heroult process is that it would not emit any greenhouse effect gas such as $CO_2$ or CO, or harmful gas at all. What would be emitted by the present invention are only oxygen and inert gas such as argon used as carrier gas or operating gas.

Next, the second embodiment of the method for reducing alumina (or could be magnesia) according to the present invention is now be described. The method for reducing alumina according to the present embodiment is basically similar to the former embodiment explained by referring to FIG. 1 and FIG. 2, except that hydrogen is further added to the operating gas to be introduced from the operating gas introducing gate 113 for the case of the present embodiment. Volume of hydrogen to be added may be about 0-50%, desirably about 1-30% in weight ratio relative to the operating gas. Hydrogen could combine with oxygen that is separated from aluminum after alumina is dissociated by heat of laser beam, and such combination promotes alumina reducing reaction. A chemical formula of such reaction is as follows.

$$Al_2O_3+3H=2Al+3H_2O-112\ kJ$$

By making use of hydrogen as a reducing agent as described above, alumina reduction may be achieved by using even fewer energy. In FIG. 3 explained above, solid line with ■ marks represents aluminum production efficiency when hydrogen is additionally used as a reducing agent. As is clear from the graph, aluminum production efficiency according to the present invention would be superior to that of the Hall-Heroult process when only about 4% of introduced energy created by laser beam is used. Further, when 35% efficiency of energy usage is realized as the case of the above mentioned experimental result, it can be expected that the present invention could achieve as much as 10 times or even higher efficiency of aluminum production (mg/kJ) compared to the Hall-Heroult process when hydrogen is added. Furthermore, what would be additionally emitted in this case is only water ($H_2O$) on the top of the former embodiment case, and no harmful gases would be emitted at all, similarly to the former embodiment.

In the examples of the above mentioned embodiments, laser beam is used as heating means for reducing alumina in thermal dissociation process instead of electrolysis in prior art, but the present invention is not limited thereto, but some other heating means may be utilized. Some examples are: arc discharge or inductively-coupled plasma. However, in case of using arc discharge, electrodes (tungsten or cupper) are consumed, and operation in oxygen environment is prohibited. In case of using conductively-coupled plasma, operating pressure is limited to less than 1 atm, and also it has a problem of interference with generated aluminum. By the laser plasma means according to the present embodiment, operation in oxygen atmosphere is possible since no consuming material such as electrode exists, and operating pressure can be kept at high level (about up to 10 atm), therefore the method according to the present invention is more suitable for realizing frozen supersonic flow.

Example 1

The method for reducing alumina according to embodiment 1 is conducted under the following assumption:

Laser specification: Continuous wave carbon di-oxide gas laser having output power of 1 KW is used. Its wave length: 10.6 μm, beam diameter: 34 mm, and lens: f95.

Throat specification: throat diameter: 1 mm, nozzle exit: 10 mm

Flow rate of alumina powder: 10% of weight ratio relative to carrier gas (argon)

Alumina powder diameter: 3 μm

Figure 4:
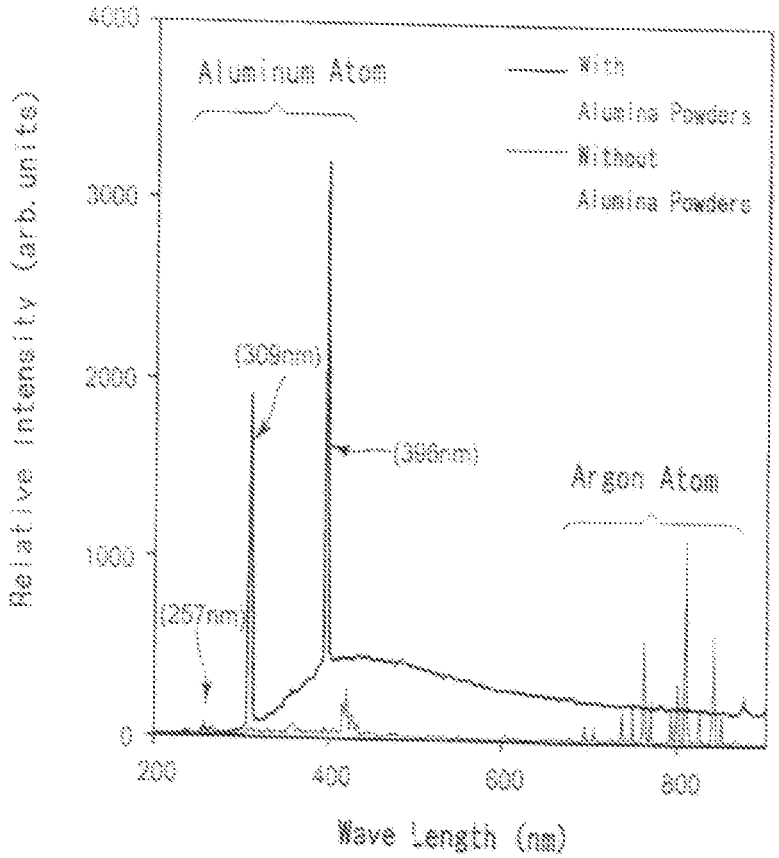
FIG. 4 is a graph showing emission spectrum observed in one embodiment of the present invention, which proves existence of atomic aluminum in the supersonic gas flow.

The result is shown in FIG. 4, in which peaks of emission spectrum (257 nm, 309 nm, 396 nm) unique to aluminum atom when it is existed was observed, through which isolation of aluminum could be confirmed.

INDUSTRIAL APPLICABILITY

The method for reducing alumina or magnesia according to the present invention may be used in industrial fields such as field of reducing alumina for producing aluminum, or field of reducing magnesia for producing magnesium.

What is claimed is:

1. A method for reducing alumina or magnesia, the method comprising:

heating alumina powders or magnesia powders by heating means for putting it in a plasma state so as to thermally dissociate aluminum or magnesium from oxygen, and ejecting gas in the plasma state in a form of a supersonic jet steam from a nozzle so as to make it in frozen flow, to thereby isolate aluminum or magnesium.

2. The method for reducing alumina or magnesia as described in claim 1, wherein;

alumina powders or magnesia powders are fed into a reducing device together with carrier gas at upstream of a throat portion provided to the reducing device, operating gas is introduced similarly at upstream of the throat portion, gas pressure of which forcedly transport the fed powders toward the throat portion, heating means heats the throat portion, thereby dissociating alumina or magnesia which is then ejected in a form of the supersonic jet gas stream from the nozzle located at downstream of the throat portion.

3. The method for reducing alumina or magnesia as described in claim 2, wherein hydrogen is added to the operating gas so as to promote reducing alumina or magnesia by action of the added hydrogen.

4. The method for reducing alumina or magnesia as described in claim 3, wherein the heating means is laser beam.

5. The method for reducing alumina or magnesia as described in claim 2, wherein the method further includes a step of further comprising controlling volume of alumina powders or magnesia powders to be fed at upstream of the throat portion.

6. The method for reducing alumina or magnesia as described in claim 5, wherein the heating means is laser beam.

7. The method for reducing alumina or magnesia as described in claim 2, wherein the method further includes a step of further comprising guiding isolated aluminum or magnesium into a cooling tube so as to deposit aluminum or magnesium inside of the cooling tube and collect the same, or a step of collecting the isolated aluminum or magnesia by using a filtering device.

8. The method for reducing alumina or magnesia as described in claim 7, wherein the heating means is laser beam.

9. The method for reducing alumina or magnesia as described in claim 2, wherein the heating means is laser beam.

10. The method for reducing alumina or magnesia as described in claim 1, wherein the heating means is laser beam.

* * * * *